United States Patent [19]

McFarland

[11] 4,049,684

[45] Sept. 20, 1977

[54] PROCESS FOR THE SEPARATION OF FAT FROM ANIMAL SKINS

[75] Inventor: Archie Rae McFarland, Sandy, Utah

[73] Assignee: Beehive Machinery Inc., Sandy, Utah

[21] Appl. No.: 611,314

[22] Filed: Sept. 8, 1975

[51] Int. Cl.[2] ..... C11B 1/06

[52] U.S. Cl. ..... 260/412; 100/117; 100/148; 260/117; 260/412.6

[58] Field of Search ..... 260/412, 412.6, 118, 260/117; 426/417, 480, 518; 100/117, 145, 148, 150

[56] References Cited

U.S. PATENT DOCUMENTS

| | | | |
|---|---|---|---|
| 2,992,247 | 7/1961 | Grettie | 260/412.6 |
| 3,071,477 | 1/1963 | Klevens | 426/417 |
| 3,398,676 | 8/1968 | Theobold et al. | 100/117 |
| 3,398,677 | 8/1968 | Theobold et al. | 100/117 |
| 3,548,743 | 12/1970 | Pikel | 100/145 |
| 3,741,772 | 6/1973 | McFarland | 426/518 |
| 3,843,997 | 10/1974 | Treharne et al. | 17/47 |

*Primary Examiner*—Winston A. Douglas
*Assistant Examiner*—P. E. Konopka
*Attorney, Agent, or Firm*—Mallinckrodt & Mallinckrodt

[57] ABSTRACT

Raw or partially cooked animal skins containing fats and oils from which the surface hair has been removed are ground into particles and fed into the end of a perforated conduit that has a conveyor screw therein which progressively decreases in conveying capacity from the feed end of the conduit to an imperforate discharge end thereof. Without the application of heat, the skin particles are compacted within the imperforate discharge end of the conduit by an extension of the conveyor screw prior to discharge following buildup and conveyance along the interior surface of the imperforate portion of the conduit through which edible fats and oils are forced toward and through the perforations of the conduit to provide a substantially fat free animal skin. The discharge passage surrounding the extension of the conveyor screw can be varied in size preferably by a tapered ring that is movable back and forth axially of the conveyor screw extension, and preferably the spacing between the conveyor screw and conduit is variable. The forward faces of the conveyor screw flights are preferably concave to provide a forwardly projecting circumferential overhang that tends to keep the particles of skin near the axis of the screw, and the conduit wall thickness is unusually thick so as to withstand high pressures. Unusually high production rates can be obtained by feeding ground animal skins into the conduit by means of a high pressure pump. The discharged fats and oils can be rendered to provide an edible animal fat and the defatted skin discharged can be treated for the recovery of high quality gelatin.

10 Claims, No Drawings

PROCESS FOR THE SEPARATION OF FAT FROM ANIMAL SKINS

BACKGROUND OF THE INVENTION

The present invention relates to a method for the separation of fats and oils from animal skins. More particularly, the present invention relates to an improved process for the separation of edible fats and oils from animal skins whereby a substantially fat free animal skin is obtained which is suitable for the preparation of high quality gelatin.

Various techniques have been employed for the separation of fats from animal tissues which are to be used in the preparation of gelatin or other proteinaceous substances. A common method for the preparation of gelatin is to soak the animal skin in an acid solution prior to the defatting of the skin. The fats recovered from such a process are inedible "greases" and the gelatin produced by such a process is of low quality. Methods heretofore proposed by the prior art to solve the problem have required the usage of large amounts of water which creates a pollution problem. These processes also generally require the application of heat to the skin to be defatted whereby the fats and oils in the skin are converted into a liquid state. Such processes have to be carefully controlled so as not to convert the collagen in the skin into a gelatinous material prior to the time that the gelatin extraction is to be performed.

In Trautman et al, U.S. Pat. No. 3,487,094, a process is disclosed wherein the animal skin is beaten in a cage mill to break down the fatty tissue. Live steam is then applied to melt the fat and the product then is washed with water to separate the fatty tissue from the animals skins.

Walter, U.S. Pat. 2,281,609, discloses a process wherein the skins are ground in a sausage grinder and dumped into a tank of water maintained at about 100° F. and subjected to violent agitation. As a result of both temperature and agitation the fat and skins separate and the fat floats to the surface and is skimmed off. The skins are pumped from the bottom of the tank and drained.

Another prior art process is disclosed in Siffert et al, U.S. Pat. No. 2,745,152, wherein the skins are ground and subjected to live steam and then passed through a series of separators and centrifuges.

It is evident that each of the above prior art processes requires the usage of both water and temperature in order to separate the fat from the animal skin to produce a skin of such condition from which to extract a quality gelatin.

BRIEF SUMMARY OF THE INVENTION

In accordance with the present invention, substantially complete separation of fat from skin may be obtained without the application of external heat or water. The fats and oils obtained are of edible quality and the defatted skin produced may be utilized for the production of proteinaceous substances including gelatin or meat casing materials such as coatings for link sausages, frankfurters and the like.

Animal skins, pork skins in particular, contain a certain amount of fat within the skin or corrium itself and in addition may contain a layer of subcutaneous fat which is left on the skin of the animal after the skinning procedure. In addition, the hair follicles will contain an oil sac in the vicinity of the base thereof, and it is imperative, in order to obtain a high quality gelatin, to first remove these fats and oils from the animal skin. Pork skins, in particular, will have a fat content which will range between about 10% to 65%. When the fat is separated from the ground skin the fat can be rendered and used for lard.

It is a primary object of this invention to provide a process for removal of substantially all fat from an animal skin by subjecting the fat containing skin to pressure, thereby separating the fat from the skin without the use of externally applied temperatures and washwaters.

It is also an object of this invention to provide a process for the removal of an edible fat from a raw or partially cooked animal skin without the use of externally applied temperatures and washwaters.

It is a further object of this invention to reduce water pollution and water consumption by extracting edible fat from an animal skin by means of subjecting the fat containing skin to external pressure thereby physically separating the fats and oils from the skin.

A still further object of the present invention is to produce an animal skin from which substantially all of the fats and oils have been removed, which skin is capable of yielding a high quality gelatin protein.

These and other objects are accomplished by means of a novel process wherein raw or partially cooked animal skins are scraped to remove the surface hair. The skins are then reduced in size by grinding or by other conventional means and the fats and oils are then separated from the ground skins by subjecting said skins to a pressure apparatus such as disclosed in U.S. Pat. No. 3,741,772, which is incorporated herein by reference, thereby physically separating the fats and oils from the defatted skin. The fats and oils thus recovered are edible and can be rendered in a conventional manner. The defatted skins are of high quality and can be cured and gelatin extracted therefrom in a conventional manner.

DETAILED DESCRIPTION OF THE INVENTION

The best form of apparatus presently developed for performing the defatting process of the present invention is an extrusion machine that comprises a perforated conduit of sufficient strength to withstand the pressures involved and a coacting, compression type of conveyer screw for applying the required pressure while transporting the ground skin through the conduit.

An annular valve at the discharge end of the conduit enables the pressure exerted on the material to be varied as may be required to produce a sufficiently defatted animal skin. The conveyer screw should fit snugly but not tightly in the conduit, so as to convey material in a continuous spiral flow, without forcing particles of skin through the perforations.

In smaller versions of the apparatus, a grinder is built into the extrusion machine, such a grinder comprising a hopper, a feed screw arranged as an advance extension of the compression screw, so as to discharge material into the feed end of the perforated conduit through a rotary-knife-and -extrusion-plate type of cutter unit that is interposed between feed and compression screws, and power means for operating the feed screws, the rotary-knife, and the compression screw as a unit. It has been found that other versions can advantageously employ a pump, usually high pressure, for feeding ground materials into the conduit.

In the operation of the extrusion machine, a spiral layer of skin immediately commences to build up against the inner wall of the perforated conduit by reason of the pressure that tends to force the material outwardly toward such wall, and such pressure causes the fats and oils present in the skin to be forced out through the perforations which it covers. The skin layer becomes thicker and thicker along the length of the compression screw until it is carried out the discharge end of the conduit by such screw.

As previously mentioned, the pressure may be varied by means of an annular valve at the discharge end of the conduit. The pressure to be applied should be sufficient to force the fats and oils in the skin and any subcutaneous fat on the skin through the perforations in the conduit and yet be insufficient to force the skin particles through the perforations. The pressure to be applied may vary from animal species to species and be somewhat dependent upon the degree of cooking the skin has received. The pressure to be applied will be determined empirically. In general, pressures of from 50 psi to 20,000 psi may be used.

The materials to be treated are first scraped of all external hair and then ground into pieces which may have a diameter as large as two inches, but which are not sufficiently small as to pass through the perforations in the conduit. The process of this invention is adaptable to any type of animal skin and is particularly adapted to a fatty hide which heretofore has required considerable manpower in scraping the fatty tissues off the hides before the hides could be processed. Such flashing or trimming of the hide is not necessary when utilizing the present invention. Various hides contain varying degrees of fat within the hide, and pork, in particular, contains a layer of subcutaneous fat which has been most difficult to completely remove.

This invention has also proven to be particularly useful in the removal of oil located in the oil sac at the base of the hair follicle. With pork skins, in particular, it has been found that by applying external pressure, not only is the oil from the oil sacs removed, but the hair which is usually scraped off at the surface level of the skin is popped completely out of the skin thereby providing a defatted skin containing little or no hair which is especially suitable for gelatin making.

By utilizing the process of the present invention fat recovery is increased over the recovery obtained from conventional methods. Skins initially contain from about 20% to about 75% by weight fat. The fat content of pork skins will be entirely dependent upon the amount of subcutaneous fat reatined upon the skin. In general, however, skins are obtained which, when defatted, contain only 5% to 18% fat remaining in the skin.

A particular advantage of the invention is that in addition to increased fat yields, the yields of gelatin and the quality of the gelatin are both increased. In addition, the overall volume utilizing the present defatting process increases the throughput by about 25%.

The following example and data contained thereon are illustrative of the present invention, but are not to be construed as limitations as to the scope of the invention. In each of the runs illustrated in the example the pressure device used was of the type disclosed in U.S. Pat. No. 3,741,772.

EXAMPLE

Pork skins were ground through a two inch orifice plate and fed into a perforated conduit tube having a motor driven compression type conveyer screw. The perforations were about 0.075 to 0.1 of an inch in diameter. The pressure in the conduit increased as the skin traveled through the conduit from the feed end to the discharge end. The fat was forced out of the conduit perforations and recovered. The defatted skin was recovered from the discharge end of the conduit. Upon close analysis it was noted that the skins were substantially free from hair, i.e., the hair roots had been popped out of their follicles by the pressure applied in the conduit tube.

Data for several runs are as follows:

TABLE

| RUN NO. | TYPE OF SKIN | POUNDS SKIN PROCESSED | INITIAL FAT CONTENT % WEIGHT | POUNDS SKIN RECOVERED | FAT CONTENT OF RECOVERED SKIN % WEIGHT | POUNDS FAT RECOVERED | PERCENT FAT REMOVED | FEED RATE POUNDS PER HOUR | CONVEYER SCREW RPM |
|---|---|---|---|---|---|---|---|---|---|
| 1 | pork ham | 111.26 | 30 | 88.5 | 12 | 22.76 | 68.18 | 4000 | 140 |
| 2 | pork ham | 131.84 | 33 | 104 | 15 | 27.94 | 64.17 | 3780 | 240 |
| 3 | pork ham | 291.25 | 32 | 233 | 15 | 58.25 | 62.50 | 3360 | 240 |
| 4 | pork ham | 250.76 | 32 | 966.5 | 12 | 284.26 | 71.02 | 3500 | 230 |
| 5 | pork jowel | 556.48 | 71 | 185.5 | 13 | 370.98 | 93.90 | 4410 | 230 |
| 6 | pork jowel | 412.90 | 90 | 46.5 | 11 | 366.4 | 98.60 | 5202 | 230 |
| 7 | pork jowel | 428.58 | 69 | 146 | 9 | 282.58 | 95.56 | 4730 | 230 |

The skins obtained from each run were superior in quality for producing protein derivatives such as the conversion of collagen into gelatin and food coverings such as casings for link sausages and frankfurters.

What is claimed is:

1. A process of producing a fat product and a separate gelatin product from the skins of slaughtered animals without the application of heat, comprising comminuting said skins in substantially raw condition to provide fragments no greater than about two inches in maximum dimension; applying screw pressure to the fragments against one side of a perforated plate with sufficient force to dislodge solid fat from the fragments and to force the dislodged fat through the perforations of said plate substantially free of skin material; collecting the so-dislodged and so-forced fat at the opposite side of said plate; and separately collecting, as gelatin stock, the residual skin material that remains at the said one side of said plate.

2. A process in accordance with claim 1, wherein the perforated plate is in the form of a tubular conduit, the fragments of comminuted skin are fed into the conduit adjacent to one end thereof, a conveyor screw within the conduit carries the skin fragments from the said one end of the conduit toward the opposite end thereof during the pressing procedure; and the residual skin material is discharged substantially free of fat at the opposite end of the conduit.

3. A process in accordance with claim 2, wherein the fragments of comminuted skin are fed into the tubular conduit under pressure.

4. A process in accordance with claim 2, wherein the pressure within the tubular conduit is regulated by valve means governing the discharge of residual skin materials from said conduit.

5. A process in accordance with claim 4, wherein the conveyor screw is of compression type and at least partially provides the pressure within the conduit.

6. A process in accordance with claim 5, wherein the fragments of comminuted skin are fed into the tubular conduit under pressure.

7. A process in accordance with claim 1, wherein the skins of slaughtered animals are subject to de-hairing treatment prior to the comminuting thereof.

8. A process in accordance with claim 1, wherein the perforations of the plate are of a diameter within the range of about 0.075 to 0.1 of an inch.

9. A process in accordance with claim 1, wherein the collected fat is subjected to rendering by the application of heat thereto.

10. A process in accordance with claim 2, wherein the residual skin material is compacted adjacent the opposite end of the conduit immediately prior to discharge.

* * * * *